US007322325B1

(12) United States Patent
Mueller

(10) Patent No.: US 7,322,325 B1
(45) Date of Patent: Jan. 29, 2008

(54) APPARATUS AND METHODS FOR VARYING VALVE LIFT IN AN INTERNAL COMBUSTION ENGINE

(75) Inventor: Hermann Mueller, Bourbonnais, IL (US)

(73) Assignee: Ideal Engine Incorporated, Arlington Heights, IL (US)

( * ) Notice: Subject to any disclaimer, the term of this patent is extended or adjusted under 35 U.S.C. 154(b) by 0 days.

(21) Appl. No.: 11/548,125

(22) Filed: Oct. 10, 2006

(51) Int. Cl.
*F01L 1/34* (2006.01)

(52) U.S. Cl. ..... 123/90.16; 123/90.15; 123/90.39

(58) Field of Classification Search ..... 123/90.16, 123/90.39, 90.45
See application file for complete search history.

(56) References Cited

U.S. PATENT DOCUMENTS

| | | | | |
|---|---|---|---|---|
| 1,271,568 | A | 7/1918 | Hall | |
| 1,509,262 | A | 9/1924 | Royoe | |
| 3,157,166 | A | 11/1964 | MacNeill | |
| 3,413,965 | A | 12/1968 | Gavasso | |
| 4,397,270 | A | 8/1983 | Aoyama | |
| 4,438,736 | A | 3/1984 | Hara et al. | |
| 4,519,345 | A | 5/1985 | Walter | |
| 4,638,773 | A | 1/1987 | Bonvallet | |
| 4,721,007 | A | 1/1988 | Entzminger | |
| 4,774,913 | A | 10/1988 | Giampa et al. | |
| 5,018,487 | A | 5/1991 | Shinkai | |
| 5,732,669 | A | 3/1998 | Fischer et al. | |
| 5,791,306 | A | 8/1998 | Williamson | |
| 5,809,951 | A * | 9/1998 | Kim | 123/90.16 |
| 6,591,797 | B2 * | 7/2003 | Entzminger | 123/90.16 |
| 6,640,759 | B1 | 11/2003 | Hendriksma | |
| 6,691,657 | B2 * | 2/2004 | Hendriksma et al. | 123/90.39 |
| 6,722,326 | B1 * | 4/2004 | Shui et al. | 123/90.16 |

* cited by examiner

*Primary Examiner*—Zelalem Eshete
(74) *Attorney, Agent, or Firm*—Patrick B. Law

(57) ABSTRACT

Apparatus and methods for varying valve lift in an internal combustion engine are disclosed. The apparatus include a rocker arm having an elongate aperture and a shaft configured to pass through the aperture. The height of the shaft with respect to the aperture is variable to effect different rocker arm ratios when in combination with a fixed fulcrum point. When the shaft is located in a lower position with respect to the aperture in the rocker arm, the rocker arm pivots around the rocker arm shaft producing full valve lift. Alternatively, when the rocker arm shaft is positioned at a height above the lower position, an upper surface of the rocker arm becomes engageable to varying degrees with the fixed fulcrum point, allowing the rocker arm to pivot around the fixed fulcrum point, thereby reducing the rocker arm ratio, and corresponding valve lift dependent on the rocker arm shaft position. Corresponding methods are also disclosed.

24 Claims, 5 Drawing Sheets

APPARATUS AND METHODS FOR VARYING VALVE LIFT IN AN INTERNAL COMBUSTION ENGINE

BACKGROUND

1. Field

The present disclosure relates to internal combustion engines and, more particularly, to apparatus and methods for varying the valve lift of a valve in an internal combustion engine by varying the fulcrum point of a rocker arm actuating the valve in order to vary the amount of valve lift over a wide range.

2. Background

In internal combustion engines, spring closed poppet-type valves contained in the cylinder head of a typical engine are designed to provide sufficient spring closing force given a full power or maximum RPM operating condition. This ensures that the poppet-type valves, which are the intake and exhaust valves, have sufficient acceleration to close quickly enough when the engine revolutions are high (i.e., a full or near full load condition). Additionally, it is known to design engines to ensure that the valve lift displacement of the poppet-type valves is sufficient for full load conditions. Accordingly, rocker arms, which are part of the mechanism for converting the rotational motion of a camshaft to motion for actuating the poppet valves, are configured with a rocker arm ratio of typically from 1.5:1 to 1.7:1 for maximum valve lift, which effectively extends the cam lift profile by that ratio.

By designing and operating an engine for full power conditions, however, excessive energy is consumed during less than full power condition, such as during engine idle conditions, where a substantial amount of the fuel consumed is simply used to rotate the camshaft, which in turn drives the rocker arms and poppet-type valves. This is due to the fact that the magnitude of full valve spring compression is substantial given that the poppet-type valves are being fully opened, thus requiring maximum force be applied for each valve opening event.

In most applications of internal combustion engines, however, operating conditions typically necessitate low to moderate power output with an according reduced fuel flow or airflow to the engine. With reduced fuel flow or airflow, lower valve lift is adequate for engine operation and full valve lift is unnecessary. Accordingly, in order to reduce energy consumption in internal combustion engines it is known to vary or lessen the valve lift to the tailored demands of intake and exhaust flow in and out of the cylinders. That is, by reducing the parasitic drag caused by valve spring compression, the caloric and thermal efficiency or net torque output of the engine may be improved. In order to reduce this drag, various mechanisms are known to either lessen or limit valve lift during periods of light engine load or even shut down or deactivate a rocker arm. Such mechanisms, however, typically add complexity to an engine, as well as height to the head portion of an engine. For example, a known approach includes an eccentric rotatable shaft and accompanying lever located above a rocker arm to vary a fulcrum point of the rocker arm. This arrangement, however, adds height to the engine block and complexity to the engine with the addition of moving parts.

Additionally, it is important when reducing valve lift to ensure that such variation of the valve lift does not result in lost motion and an increase in lash, which some known approaches do not adequately provide. Further, the mechanisms for varying valve lift should maintain push rod tightness, in the case of a push rod type engine, and should not change valve timing, which some known approaches fail to provide. Another consideration when reducing valve lift is to maintain the strike effect (i.e., what is known as "Long arm" strike effect) such that the tip of a rocker arm substantially maintains the same positioning with respect to the valve stem.

SUMMARY

According to an aspect of the present disclosure, an internal combustion engine including an engine head portion with a variable lift apparatus for opening and closing a poppet valve is disclosed. The apparatus includes a rocker arm having a body defining an elongate aperture, a first end, a second end, and an upper surface, where the first end is configured to receive an actuating device, and the second end is configured to engage an end of the poppet valve. The apparatus further includes a fixed fulcrum surface that is fixed in a position relative to the engine head portion and configured to engage the upper surface of the rocker arm, and a rocker arm shaft configured to pass through the elongate aperture and having a cross-section dimension smaller than a width of the elongate aperture such that the rocker arm shaft is selectively movable within the aperture in an elongate direction of the elongate aperture between an upper position and a lower position such that the rocker arm pivots around the rocker arm shaft when the rocker arm shaft is in the lower position and the upper surface of the rocker arm engages with the fixed fulcrum surface when the rocker arm shaft is in the upper position such that the rocker arm is movable to engage and pivot around the fixed fulcrum surface.

According to another aspect of the present disclosure, a variable lift apparatus for valve lift displacement in an internal combustion engine is disclosed. The apparatus includes a rocker arm having a body defining an elongate aperture, a first end, a second end, and an upper surface, where the first end is configured to receive an actuating force, and the second end is configured to engage an end of the valve. The apparatus further includes a fixed fulcrum point that is fixed relative to an engine head portion and configured to engage the upper surface of the rocker arm. The apparatus also includes a rocker arm shaft configured to pass through the elongate aperture and having a cross-section smaller than the elongate aperture such that the rocker arm shaft is selectively movable within the aperture in a vertical direction between at least an upper position and at least a lower position such that the rocker arm pivots around the rocker arm shaft when the rocker arm shaft is in the lower position and the upper surface of the rocker arm engages with the fixed fulcrum surface when the rocker shaft is in the upper position and is pivotable around the fixed fulcrum surface.

According to still another aspect of the present disclosure, a method is disclosed including providing a first pivot point around which a rocker arm of the internal combustion engine may rotate wherein the first fulcrum point is variable in position. The method further includes providing a second fixed pivot point in a fixed position relative to an engine head portion to be engageable with an upper surface of the rocker arm. Next, the method includes rotating the rocker arm around at least the first pivot point when the first pivot point is positioned in a position such that rocker arm engages the first pivot point. Finally, the method includes rotating the rocker arm around at least the second fixed pivot point when the first pivot point is positioned in a position such that the rocker arm is movable to engage and pivot around the second fixed pivot point.

BRIEF DESCRIPTION OF THE DRAWINGS

It is noted that like numerals refer to like parts throughout the several views of the drawings.

DETAILED DESCRIPTION

The present description discloses apparatus and methods for varying (e.g., reducing) valve lift in an internal combustion engine that afford selective adjustment of the amount of valve lift during operation of the engine, without a significant increase in the engine space required for the apparatus, nor the addition of numerous additional components and complexity. A reduction in valve lift during modes of engine operation results in reduced effort of the engine for valve actuation, thus increasing overall engine efficiency. Additionally, the presently disclosed apparatus and methods do not result in added lash, significant changes in valve timing, or lost motion of a rocker arm. Moreover, the presently disclosed apparatus and methods afford valve lift variation while maintaining the long arm strike effect such that an end of the rocker acting on a valve stem maintains essentially the same position with respect to the stem.

Figure 1:
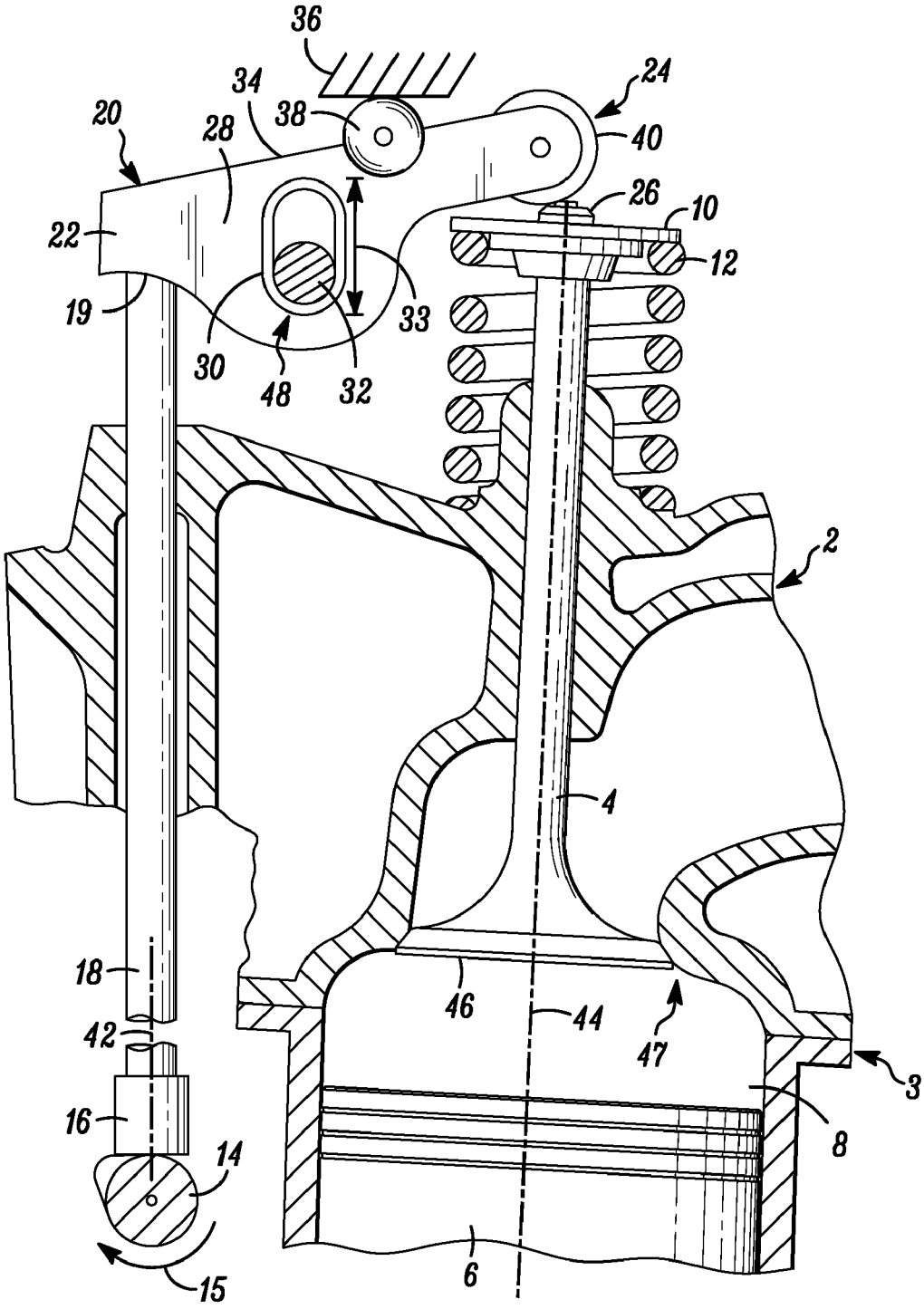
FIG. 1 is a partial sectional view of a portion of an overhead valve, pushrod, internal combustion engine including the presently disclosed mechanism in a normal work position and a poppet valve in the closed position.

FIG. 1 is a partial sectional view of a head portion of an overhead valve, push rod, internal combustion engine including an example of the presently disclosed apparatus for varying (e.g., reducing) valve lift. As shown in FIG. 1, the head portion of the engine 2 includes a poppet-type reciprocating valve 4. The head portion 2 is mounted to an engine block 3, which includes a piston 6 with the head 2, block 3, and piston 6 defining a combustion chamber 8. It is noted that the poppet-type valve 4 may represent either an intake valve or an exhaust valve. Poppet-type reciprocating valve 4 also includes a retainer 10 at an upper end 26 of the valve 4 and a valve spring 12 disposed between the retainer 10 and the engine head 2 to provide a biasing force toward the closed position of valve 4, which is shown FIG. 1.

FIG. 1 also illustrates a camshaft 14 of the engine that engages with a tappet 16 or similar device located at an end of a push rod 18. The tappet 16 rides on the camshaft 14, which translates the rotational motion of the cam 14 (indicated by arrow 15) into linear motion that is a reciprocating motion of the push rod 18. The push rod 18 extends through the head 2, having a distal end 19 that engages with a rocker arm 20 at a first end 22 of the rocker arm 20. A second end 24 of the rocker arm 20 engages with the upper end 26 of poppet-type valve 4. Thus, the valve train, which actuates the valve 4, includes camshaft 14, tappet 16, push rod 18, and rocker arm 20.

Rocker arm 20 includes a body portion 28 which includes or defines an elongate aperture 30. A rocker arm pivot shaft 32, which may be cylindrical as shown, is engaged with and passes through the aperture 30 and constitutes a pivot or fulcrum point around which the rocker arm 20 may rotate for certain modes of operation, most notably when effecting full valve lift displacement of valve 4. As may be seen in FIG. 1, the elongate aperture 30 has a dimension 33 in the elongate direction (as well having width dimensions at least slightly greater than the cross sectional diameter of shaft 32) that permits shaft 32 to travel or move in a generally vertical direction within aperture 30, as will be discussed in more detail below. Rocker arm 20 also includes an upper or top surface 34 located in proximity to a secondary fixed fulcrum point or surface 36. The upper surface 34 may be selectively engaged with the secondary fulcrum point 36 dependent on positioning of the rocker arm pivot shaft 32 within the aperture 30, which will be discussed in more detail with respect to FIGS. 3 and 4. Alternatively, rocker arm 20 may also include one or more rollers 38 affixed thereto in proximity of upper surface 34. The one or more rollers 38 are rotatable and engage with the secondary fixed fulcrum point 36 to effect a pivot point around which rocker arm 20 rotates.

The fixed fulcrum point or surface 36 is positioned with respect to the engine head 2 (or other fixed engine elements, such as block 3 or engine head covers (not shown) attached to the head 2) to provide a stationary surface or point with respect to the engine valve 4 and rocker arm 20. As examples, the fulcrum point 36 may consist of a bar, protrusion, shaft, or similar device that may be fixedly positioned with respect to the head 2 or other stationary part of the engine, and may be affixed by any number of suitable means as will be appreciated by those skilled in the art. It is further noted that the fulcrum point 36 may be made an integral part of the engine, such as part of the head 2 or a head cover, or made be a non-integral element (i.e., a separate element) that is affixed to a stationary portion of the engine.

According to an example of the apparatus of FIG. 1, rocker arm 20 may also include a rocker arm roller tip 40 at second end 24 that engages with the top end 26 of poppet-type valve 4. It is further noted that the particular geometry of rocker arm 20 illustrated in the present application is merely exemplary, and one skilled in the art will appreciate that any number of suitable shaft mounted rocker arm designs, geometries and configurations may utilized with the presently disclosed apparatus.

In operation, the system shown in FIG. 1 will operate such that the when the engine camshaft 14 is rotating, this rotation will impart reciprocating motion to tappet 16 and pushrod 18 along a fixed pushrod axis 42. The pushrod 18, in turn, pushes on end 22 of rocker arm 20, which imparts motion to rocker arm 20, which is translated to rotational motion around the rocker arm pivot shaft 32. Reciprocating linear motion of poppet-type valve 4 occurs along a reciprocating axis 44 and is imparted by the rotational motion of the rocker arm 20 as the end 24 engages with upper end 26.

FIG. 1, in particular, illustrates one stage in the operation of the engine where the valve 4 is in a closed position and a valve head 46 of valve 4 is seated at a portion 47 of the engine head 2. Additionally, the valve spring 12 is not compressed or is at its least compressed state. When the rocker arm pivot shaft 32 is at a lower or bottom position 48 within the elongate aperture 30, the rocker arm 20 is configured in this mode to effect a maximum valve lift. As an example, maximum valve lift is typically around 0.45 inches given a displacement of pushrod 18 (i.e., cam lift of camshaft 14) of approximately 0.3 inches and a rocker arm ratio of 1.5:1 to 1.7:1. It is noted that the position or height of shaft 32 may be varied with respect to the head 2 or other fixed engine portion by a position adjustment mechanism (not shown). In the full lift mode of FIGS. 1 and 2, the height adjustment mechanism holds the shaft 32 fixed at the bottom position 48 so that the rocker arm 20 rotates only around the shaft 32 because no vertical movement of the rocker arm body can occur since the shaft 32 is at the bottom of elongate aperture 30.

Figure 2:
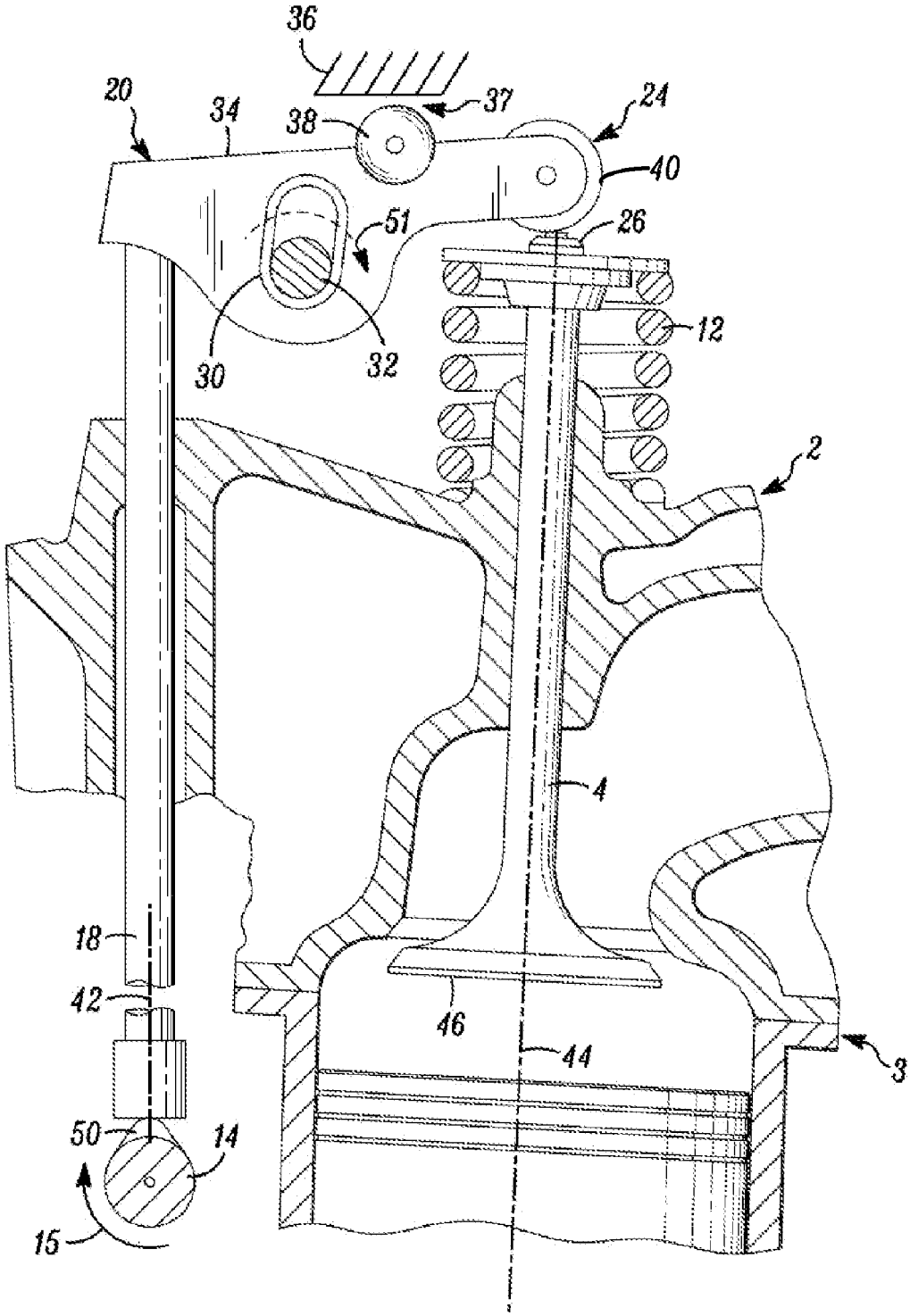
FIG. 2 is a partial sectional view of the engine illustrated in FIG. 1, wherein the presently disclosed mechanism is in a normal work position and the poppet valve in a fully open position.

FIG. 2 is a partial sectional view of the engine illustrated in FIG. 1, wherein the disclosed exemplary apparatus is in a full lift mode (e.g., shaft 32 is positioned at bottom portion 48 of aperture 30) and the poppet-type valve 4 in a fully open or full lift position. In particular, FIG. 2 shows the point of maximum valve lift for the full lift mode of the shaft 32 when the camshaft 14 has rotated such that camshaft lobe 50 pushes on tappet 16 causing the maximum vertical displacement of the pushrod 18 along axis 42. This vertical displacement, in turn, causes the rocker arm 20 to rotate around shaft 32 as indicated by arrow 51 where the second end 24 (e.g., with roller tip 40) applies force to the top end 26 of valve 4 which exceeds the force of spring 12 causing linear motion downward along axis 44 thus opening valve 4. As may be seen in FIG. 2, the valve 4 is open, with a vertical displacement of the valve 4 such that the valve head 46 no longer is seated in the engine head 2. Since the rocker arm 20 rotates around shaft 32, which is the pivot point, a gap 37 exists between the top surface 34 of rocker arm 20 and the second fixed pivot or fulcrum point 36.

As an example of the degree of valve lift engendered during full lift mode positioning of the shaft 32, a rocker arm having a 1.5:1 rocker arm ratio and given a maximum vertical pushrod lift of 0.3 inches, will produce a valve lift of valve 4 of 1.5×0.3 inches=0.45 inches along axis 44. It is noted that the valve lift displacement values and, thus rocker arm ratio, will vary dependent on the particular rocker arm geometry utilized and that one skilled in the art will appreciate any number of rocker arm ratio and geometries are contemplated for use in the presently disclosed apparatus.

Figure 3:
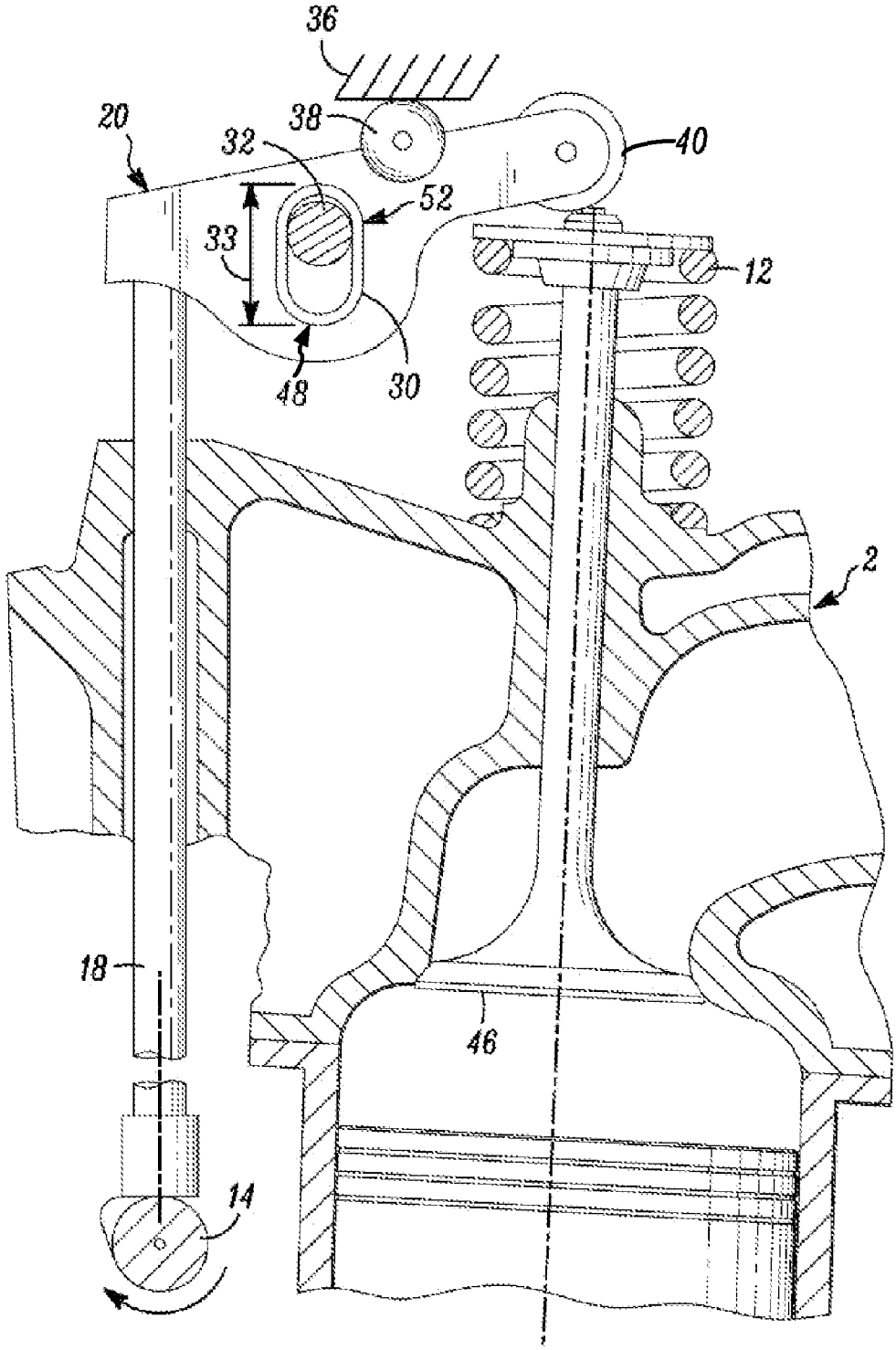
FIG. 3 is a partial sectional view of the head portion of an overhead valve, pushrod, internal combustion engine of FIG. 1 including the presently disclosed mechanism in a reduced or low lift position and a poppet valve in the closed position.

FIG. 3 illustrates a partial sectional view of the overhead valve, pushrod type internal combustion engine of FIG. 1 showing the presently disclosed apparatus in a reduced work or lower lift mode. In this view of the lower lift positioning or mode, the poppet-type valve 4 in the closed position. As shown, the rocker arm pivot shaft 32 is now positioned in an upper position 52 relative to head 2 or any stationary portion of the engine, such as with a position adjustment mechanism discussed previously. Accordingly, the shaft 32 is positioned at an upper portion within the elongate aperture 30 It is noted that when the camshaft 14 is rotationally positioned to not displace rocker arm 18 and, thus, valve opening, as is illustrated in FIG. 3, the position of rocker arm 20 when shaft 32 is in the lower load position (i.e., upper position 52) is the same as the full load or bottom position 48. Positioning shaft 32 in upper position 52, however, allows the rocker arm 20 to pivot around second fixed fulcrum point 36, as will be explained in connection with FIG. 4. It is noted that the elongate dimension or direction 33 of the elongate aperture 30 is selected such that the top, inside surface of the elongate aperture 30 is above or exceeds that upper limit position 52 of the shaft 32. In this way, it is ensured that vertical change in the position of the shaft 32 does not cause vertical movement of the rocker arm 20 by impinging upon the top, inside surface of aperture 30

Figure 4:
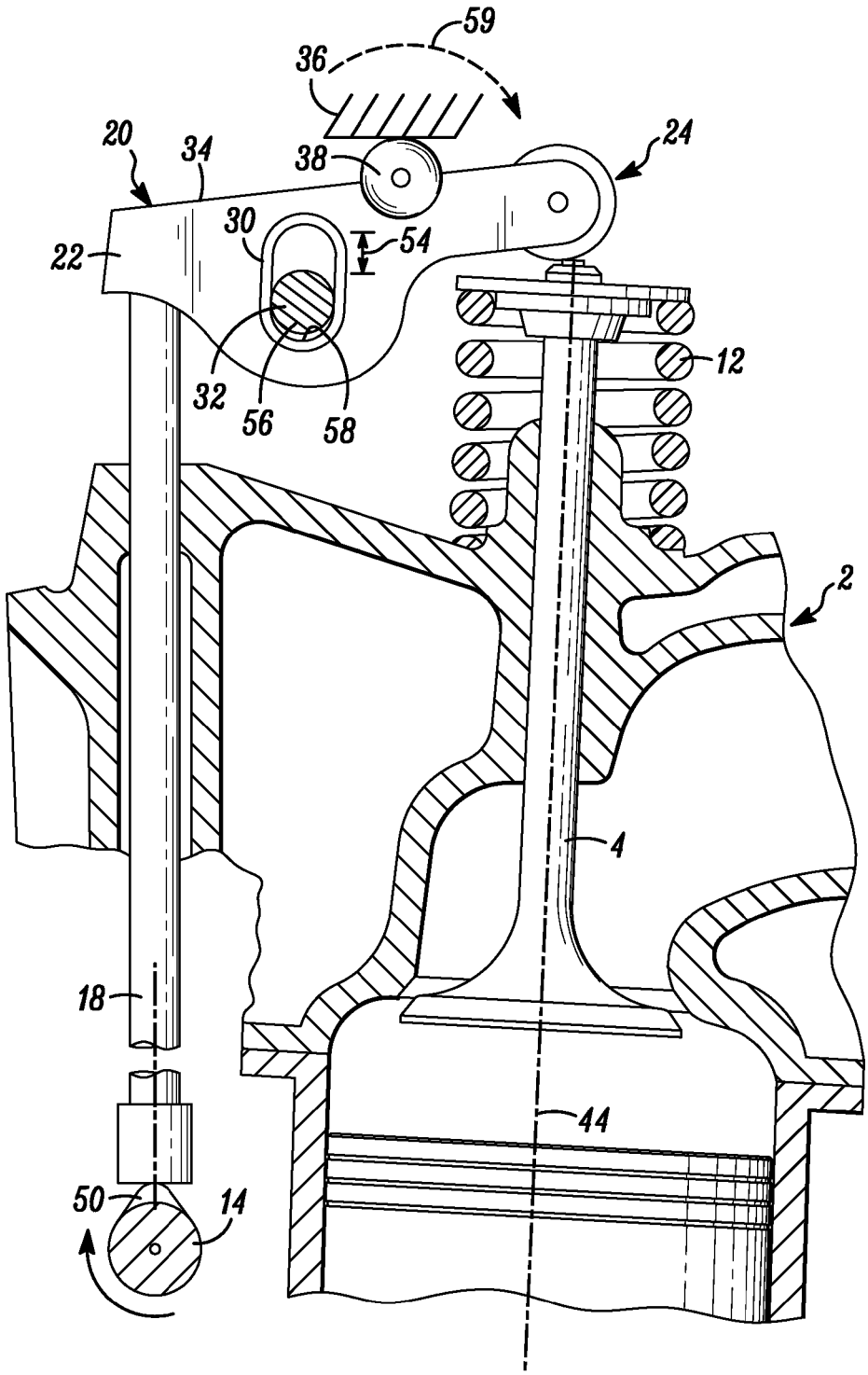
FIG. 4 is a partial sectional view of the engine head illustrated in FIG. 3, wherein the presently disclosed mechanism is in a reduced or low lift position and the poppet valve in an open position with reduced lift.

FIG. 4 illustrates a partial sectional view of the engine illustrated in FIG. 3, wherein the presently disclosed apparatus effects a reduction in the valve lift displacement, with the apparatus in low lift positioning or mode. Specifically, the camshaft lobe 50 is at its maximal height displacing pushrod 18 to its maximal height. Different from the full lift mode illustrated in FIG. 2, however, the poppet valve 4 is opened, but with reduced lift compared with the full lift position. This reduction in valve lift is due to the position of shaft 32 being raised, thus changing the position of shaft 32 within aperture 30 allowing travel of the first end 22 of rocker arm 20 by a maximum distance 54 from the bottom surface 56 of aperture 30 to or almost to a complementary bottom surface 58 of the shaft 32 as the rocker arm 20 rotates around the pivot point 36 as indicated with arrow 59.

In the presently illustrated example, the rocker arm 20 may include the one or more rollers 38, which engage the second fixed fulcrum surface 36, allowing ease of pivoting for rocker arm 20, as well as reducing wear and friction for any lateral travel of the rocker arm 20 with respect to surface 36. In another example, however, the top surface 34 of the rocker arm may be configured without roller(s) 36, wherein the top surface 34 contacts the secondary fulcrum point 36. It is to be understood that in either example, when the roller(s) 36 or top surface 34 are allowed to engage or contact the secondary fixed fulcrum point 36, a reduced noted that the degree which the ratio is reduced may be significantly less than the full lift rocker arm ratio. As an example, the ratio may be reduced from approximately 1.6:1 to 1.7:1 for full lift, to 0.5:1 to 0.7:1 for reduced lift. This reduction in the rocker arm ratio to such magnitudes is significant in that the rocker arm ratio for reduced lift mode is approximately the inverse ratio of the full lift mode. Using the numerical example presented previously, if the pushrod 18 has a linear displacement of 0.3 inches, a reduced rocker arm ratio of 0.66:1 (which is the inverse of 1.5:1), for example, would produce a valve lift of approximately 0.2 inches (i.e., 0.66×0.3).

Since the force required to perform compression of a typical valve spring, such as spring 12, variably increases with the degree or distance of compression (e.g., 100 lbs force for 0.2 inches of compression, whereas 175 lbs of force is needed to effect 0.45 inches of compression), the reduced rocker arm ratio results in less force required to actuate valve 4 and, thus, less work expended. Additionally it is noted that by varying the rocker arm ratio, the moment of rocker arm 20 is changed due to a change of the pivot from shaft 32 at the bottom of aperture 30 to secondary fulcrum point 36. Thus, the amount of force applied to end 22 of rocker arm 20 may be reduced to achieve lift of valve 4, thereby conserving energy over the full load setting.

Figure 5:
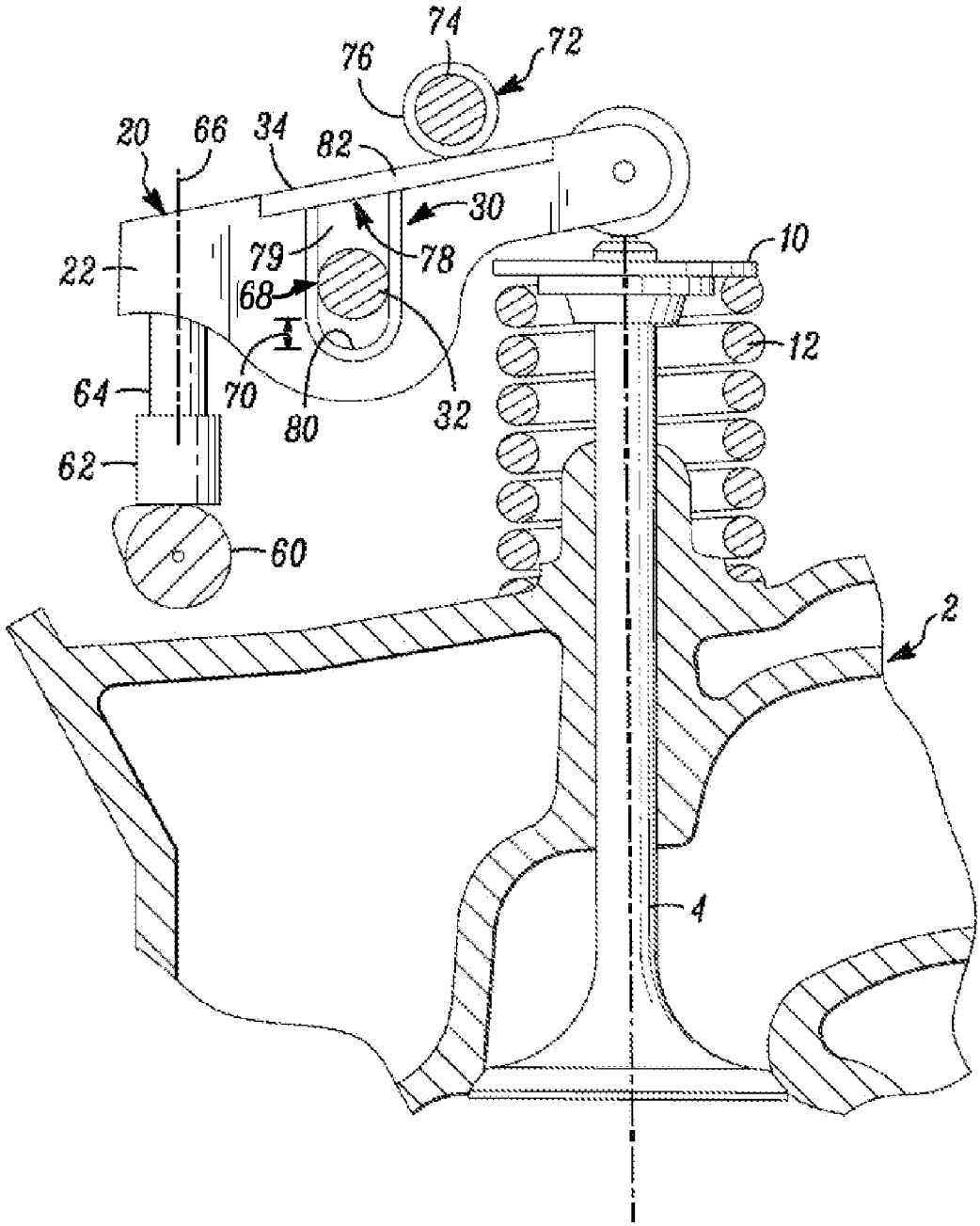
FIG. 5 is a partial sectional view of a portion of an engine of an overhead cam internal combustion engine including an example of the presently disclosed mechanism.

FIG. 5 is a partial sectional view of an example of the presently disclosed apparatus implemented in an overhead cam type internal combustion engine, rather than in a pushrod type engine. In this example, an overhead cam 60 engages a plate or tappet 62 for translating the rotational motion of the cam 60 to reciprocating motion. In turn, a rod 64 connected to tappet 62 engages with the first end 22 of rocker arm 20. Alternatively, the rocket arm 20 could be constructed with a plate or surface to directly contact the overhead camshaft 60 as long as reciprocating motion along an axis 66 is ensured.

FIG. 5 also illustrates shaft 32 passing through and engaged with the elongate aperture 30. The height of the shaft is illustrated in an intermediate position 68 within aperture 30. In this position, upon upward motion along axis 66 resultant from camshaft 60, the rocker arm 20 would be allowed to pivot around second fulcrum surface or point (shown here alternatively as a shaft 72, to be discussed below) until the rocker arm 20 has traveled a distance resulting in the aperture 30 moving a distance 70 from the initial displacement between the bottom of shaft 32 and the bottom of aperture 30. Once the shaft 32 and the bottom of aperture 30 engage, the remaining motion would be rotation of the rocker arm 20 around shaft 32. Accordingly, one skill in the art will appreciate that the resultant valve lift will be a displacement less than full valve lift, but greater than the minimum valve lift engendered when shaft 32 is located at its maximal upper position. In this way, the degree of valve lift may be selectively varied over a range of values by selectively adjusting the height of the shaft 32 within aperture 30. Although this alternative example of adjustable valve lift has been described in connection with the discussion of FIG. 5, one skilled in the art will appreciate that this example is also applicable to the examples of FIGS. 1-4.

As a further alternate example, FIG. 5 also illustrates that a shaft 72 may be used in place of fixed fulcrum point or surface 36. The cylindrically shaped shaft 72 is merely exemplary one skilled in the art will appreciate that other geometries may be utilized instead. Further, in the case of a cylindrically shaped shaft, an inner shaft 74 may be utilized with a concentric sleeve 76, for example, which is rotatable around the inner shaft. Such an arrangement may serve to reduce friction due to any lateral motion of the upper surface 34 of rocker arm 20 when rotating around the shaft 72 serving as the fulcrum point.

According to yet another alternate example, FIG. 5 further illustrates that elongate aperture 30 does not need to be configured having an arcuate shape at an upper portion 78. Rather, elongate aperture 30 may be defined as an elongate slot 79 with an arcuate bottom portion 80 to facilitate rotation around shaft 32 when positioned in less than the lowest lift mode positioning. The upper portion 78 of elongate aperture may be either left open or include a plate 82 to define a closed aperture and provide structural support for the rocker arm 20.

As was mentioned above, that the secondary fixed fulcrum surface may be configured as a bar, protrusion from the head, or other equivalent device. It is further noted that one skilled in the art will appreciated that the geometry of fixed fulcrum point or surface may be rounded or similarly shaped to adjust or fine tune the rocker arm ratio and, thus, the valve lift. Moreover, it is contemplated that the height or position of shaft 32 may be selectively varied at intermediary positions between the upper and lower positions in order to more selectively vary the amount of valve lift. One skilled in the art will further appreciate that the rocker arm geometry is merely exemplary and that numerous varied geometries of profiles of the rocker arm and rocker may be contemplated to effect any one of a number of various rocker arm ratios over a wide range of different ratios.

It is also noted that any number of suitable mechanisms such as a cammed or eccentric bearing, as examples, which would cause the shaft height to vary as the shaft is rotated, may effect the height adjustment mechanism. A rotational motive force, in such an example, could be delivered by mechanical or electromechanical means, and regulated by a control system configured to vary the shaft height responsive to the current engine load or speed. Furthermore, one skilled in the art will appreciate that any number of control systems may be used to control the height adjustment mechanism to selectively vary the height of rocker arm shaft 32 during engine operation responsive to the various operative states of the engine (e.g., idle, normal driving, full load, or maximum RPM conditions).

Of further note, the illustrated geometry of rocker arm pivot shaft 32 is merely exemplary. One skilled in the art will appreciate that instead of cylindrical shaft, other geometries could be utilized, such as eccentric cross sectional shape.

Although apparatus for holding the shaft 32 and the rocker arm 20 in place have not been specifically disclosed herein, it is noted that the presently disclosed mechanism nonetheless is effective to maintain proper valve action geometry in left/right plane, front/back plane, rotational geometry, and tipping.

It is also contemplated the disclosed apparatus could be configured as a kit of parts to be added to a standard or stock engine. In this case, the rocker arm(s) of an existing engine would be replaced with the presently disclosed rocker arms or rocker arm assembly having the elongate aperture. Additionally, the rocker arm shaft(s) and a position varying mechanism would be added and fixed fulcrum point or surface would be secured to a stationary portion of the engine, such as the engine head or engine head covers. In light of the foregoing examples, the present disclosure affords a low complexity valve lift reduction apparatus, which also does not result in material delays in valve timing, lost motion, or significantly affect the height of an engine head assembly. Of further significance, the presently disclosed apparatus also provides an arc geometry of end 24 of rocker arm 20, as it impinges on and moves the top 26 of valve 4 that is essentially the same for the full lift and reduced lift settings. It is also noted that the presently disclosed apparatus further achieve a balanced engine. Also, by affording reducing valve lift during certain periods of engine operation and the force required to operate the valve during those periods, the engine will be more fuel efficient, less friction will occur resulting in reduced wear and tear. Of yet further significance, it is noted that the present apparatus may be utilized in an engine with a standard, unmodified fuel system when low lift mode (e.g., idle conditions) is the baseline.

It is noted that the drawings presented in this disclosure are not intended to define the precise proportions of the elements, nor have they been intended to show particular sizes.

The above-detailed examples have been presented for the purposes of illustration and description only and not by limitation. It is therefore contemplated that the present disclosure cover any additional modifications, variations, or equivalents that fall with in the spirit and scope of the basic underlying principles disclosed above and the appended claims.

What is claimed is:

1. An internal combustion engine including an engine head portion with an apparatus for varying opening lift displacement of a valve of the engine, the apparatus comprising:

a rocker arm having a body defining an elongate aperture, a first end, a second end, and an upper surface, where the first end is configured to receive an actuating device, and the second end is configured to engage an end of the valve;

a fixed fulcrum point in a fixed position relative to the engine head portion so as to be engageable with the upper surface of the rocker arm, and a rocker arm shaft configured to pass through the elongate aperture and having a cross-section dimension smaller than a width of the elongate aperture such that the rocker arm shaft is selectively movable within the aperture in the elongate direction of the aperture between a lower position and an upper position such that the rocker arm is pivotable around the rocker arm shaft when the rocker arm shaft is in lower position and the upper surface of the rocker arm is engageable with the fixed fulcrum point when the rocker arm shaft is in the upper position such that the rocker arm is movable to engage and pivot around the fixed fulcrum point.

2. The internal combustion engine as defined in claim 1, further comprising:

a position adjustment mechanism configured to selectively vary a position of the rocker arm shaft.

3. The internal combustion engine as defined in claim 1, wherein the actuating device includes at least one of an engine camshaft and a pushrod.

4. The internal combustion engine as defined in claim 1, wherein the opening lift displacement of the valve is at a maximum value when the shaft is positioned in the lower position.

5. The internal combustion engine as defined in claim 1, wherein the opening lift displacement of the valve is less than the maximum when the shaft is positioned in a position other than the lower position.

6. The internal combustion engine as defined in claim 1, wherein a resultant opening lift displacement of the valve when the shaft is positioned in the upper position is less than the opening lift displacement of the valve when the shaft is positioned below the upper position.

7. The internal combustion engine as defined in claim 1, wherein the lower position of the shaft correlates to a full lift setting of the apparatus.

8. The internal combustion engine as defined in claim 1, wherein positions of the shaft above the lower position correlate to reduced load settings of the apparatus.

9. The internal combustion engine as defined in claim 1, wherein the fixed fulcrum point comprises a surface integral with the engine and fixed relative to stationary portions of the engine.

10. The internal combustion engine as defined in claim 9, wherein the surface integral with engine includes one of a valve cover frame and a valve cover plate.

11. The internal combustion engine as defined in claim 1, wherein the fulcrum surface is configured as a shaft.

12. The internal combustion engine as defined in claim 11, wherein the shaft includes a sleeve concentric and rotatable around the shaft.

13. The internal combustion engine as defined in claim 1, wherein the upper surface of the rocker arm includes at least one roller configured to engage with the fixed fulcrum point.

14. A variable lift apparatus for varying lift displacement of a valve in an internal combustion engine comprising:

a rocker arm having a body defining an elongate aperture, a first end, a second end, and an upper surface, where the first end is configured to receive an actuating force, and the second end is configured to engage an end of the valve;

a fixed fulcrum point that is fixed relative to an engine head, and a rocker arm shaft configured to pass through the elongate aperture and having a cross-section smaller than the elongate aperture such that the rocker arm shaft is selectively positionable within the aperture between at least an upper position and at least a lower position such that the rocker arm pivots around the rocker arm shaft when the rocker arm shaft is in the lower position and the upper surface of the rocker arm engages with the fixed fulcrum surface when the rocker shaft is in the upper position and is pivotable around the fixed fulcrum point.

15. The variable lift apparatus as defined in claim 13, further comprising:

a position adjustment mechanism configured to vary a position of the rocker arm shaft relative to the elongate aperture.

16. The variable lift apparatus as defined in claim 14, wherein the actuating force is received from at least one of an engine camshaft and a pushrod.

17. The variable lift apparatus as defined in claim 14, wherein a resultant lift displacement of the valve when the shaft is disposed in the upper position is less than the lift displacement of the valve when the shaft is disposed in a position below the upper position.

18. The variable lift apparatus as defined in claim 14, wherein the valve is a poppet-type valve.

19. The variable lift apparatus as defined in claim 14, wherein the lower position of the shaft correlates to a full lift setting of the variable lift apparatus.

20. The variable lift apparatus as defined in claim 14, wherein positions of the shaft within the elongate aperture above the lower position correlate to reduced lift settings of the variable lift apparatus.

21. The variable lift apparatus as defined in claim 14, wherein the apparatus comprises a kit configured to be added to a standard internal combustion engine.

22. A method for varying valve lift of a valve in an internal combustion engine comprising:

providing a first pivot point around which a rocker arm of the internal combustion engine may rotate wherein the first fulcrum point is variable in position;

providing a second fixed pivot point in a fixed position relative to an engine head portion so as to be engageable with an upper surface of the rocker arm, rotating the rocker arm around at least the first pivot point when the first pivot point is positioned in a position such that rocker arm engages the first pivot point; and rotating the rocker arm around at least the second fixed pivot point when the first pivot point is positioned in a position such that the rocker arm is movable to engage and pivot around the second fixed pivot point.

23. The method as defined in claim 22, wherein an opening lift displacement of the valve is at a maximum value when the first pivot point is positioned at a minimal position.

24. The internal combustion engine as defined in claim 22, wherein the opening lift displacement of the valve is at a minimum when the first pivot point is positioned such that the rocker arm does not engage with the first pivot point.

* * * * *